US006452473B1

(12) United States Patent
Suzuki et al.

(10) Patent No.: US 6,452,473 B1
(45) Date of Patent: Sep. 17, 2002

(54) MULTILAYER INDUCTOR AND METHOD OF MANUFACTURING THE SAME

(75) Inventors: Yasuo Suzuki; Yoshinari Noyori; Mikio Kitaoka; Tatsuhiko Nawa, all of Minato-ku (JP)

(73) Assignee: FDK Corporation, Tokyo (JP)

( * ) Notice: Subject to any disclaimer, the term of this patent is extended or adjusted under 35 U.S.C. 154(b) by 0 days.

(21) Appl. No.: 09/831,310

(22) PCT Filed: Sep. 12, 2000

(86) PCT No.: PCT/JP00/06227

§ 371 (c)(1),
(2), (4) Date: May 8, 2001

(87) PCT Pub. No.: WO01/22443

PCT Pub. Date: Mar. 29, 2001

(30) Foreign Application Priority Data

Sep. 17, 1999 (JP) ..... 11-264157
Aug. 14, 2000 (JP) ..... 2000-245559

(51) Int. Cl.[7] ..... H01F 5/00

(52) U.S. Cl. ..... 336/223; 336/200; 336/232

(58) Field of Search ..... 336/200, 223, 336/232

(56) References Cited

U.S. PATENT DOCUMENTS 5,045,380 A * 9/1991 Kobayashi et al. ..... 428/195
6,154,114 A * 11/2000 Takahashi ..... 336/200

FOREIGN PATENT DOCUMENTS

| | | |
|---|---|---|
| JP | 7-245228 | 9/1995 |
| JP | 10-112409 | 4/1998 |
| JP | 11-16758 | 1/1999 |
| JP | 11-204367 | 7/1999 |

* cited by examiner

*Primary Examiner*—Anh Mai
(74) *Attorney, Agent, or Firm*—Wenderoth, Lind & Ponack, L.L.P.

(57) ABSTRACT

A laminated inductor used for micro-miniaturized high frequency circuit includes insulating layers and conductive patterns alternately superimposed with each other, and the end of each conductive pattern is connected with each other to form a coil 3 in a laminated form. The starting end and terminal end of the coil 3 are connected with terminal electrodes 4, 5 at the opposed ends of the chip. The terminal electrodes 4, 5 are formed on, exception the side surface of the chip, the end surface and the lower surface of the chip or otherwise the end surface and upper and lower surfaces of the chip. This structure can minimize an adjacent portion between the coil 3 and the terminal electrodes 4, 5 so that a stray capacitance can be reduced. Thus, a high resonant frequency can be obtained for high frequency applications.

8 Claims, 8 Drawing Sheets

MULTILAYER INDUCTOR AND METHOD OF MANUFACTURING THE SAME

BACKGROUND OF THE INVENTION

This invention relates to an inductor used for a high frequency circuit such as a mobile communication apparatus and instruments. More particularly, it relates to a laminated or multi-layered inductor having a miniaturized configuration and for a high frequency application and a method of producing such an inductor.

A laminated inductor, which is illustrated at reference numeral 2 in FIGS. 14(*a*) and 14(*b*), is known to have a structure of a chip component (of semiconductor integrated circuits) which permits "surface mounting" so that it can be mounted on printed circuit boards, etc. The laminated inductor 1 has terminal electrodes 4, 5 at opposed ends of the chip for connection with outer circuits, and a coil 3 in the chip so that ends of the coil 3 extend outside to be connected with the outer circuits. The coil 3 is formed such that electrically insulating layers of either magnetic material or non-magnetic material and conductive patterns are alternately superimposed or laminated with each other, and the ends of each of the conductive patterns are connected in turn to form a laminated construction.

Soldering properties of the terminal electrodes 4, 5 at the time of surface mounting are largely dominant or influential to a reliability of the chip components and, therefore, in order to ascertain a suitable bonding strength, the terminal electrodes 4, 5 are formed into a box-like structure to enclose the end surfaces of the chip component so that the box-like structure covers the side surfaces and upper and lower surfaces of the chip, as illustrated in FIGS. 14(*a*) and 14(*b*).

However, in the box-like structure of the electrodes described above, its end portions are extended inwardly toward the coil 3 in the chip so that the terminal electrodes 4, 5 are positioned closer to each other. Therefore, it is likely that a stray capacitance C is generated between the terminal electrodes 4, 5 and the coil portions (that is, the upper-right and lower-left portions of the box-like structure of FIG. 14(*b*)) where an electric potential is relatively large. Consequently, the resonance frequency is not as increased as expected by the influence of the stray capacitance C, and the Q-factor of the coil is lowered. Thus, there is a problem that it is difficult to provide a suitable application for a high frequency. Particularly, through a recent diffusion and spread of personal computers (PC) and local area network (LAN), a large demand has been made to use an ultra-high frequency band exceeding 2 GHz, and it has been necessary to meet with the requirement of further and higher frequency applications due to an increase of resonance frequency, in the chip type laminated inductor.

In order to lower a stray capacitance, it is sufficient to minimize the extended portions of the terminal electrodes 4, 5. In the conventional method of forming the terminal electrodes 4, 5, a complex technique, which is called a dip method, has been used to dip a tip end into a predetermined depth of a paste for the terminals, but this method has some difficulties in seeking a high dimensional accuracy due to stain and soil of the paste. Accordingly, it has been extremely difficult to provide small sized electrodes. Furthermore, reduction of the extended portions of the terminal electrodes results in another disadvantage of lowering the bonding strength at the time of the mounting or packaging of parts and elements.

At the time of dipping in the dip method, it is necessary to have a portion in the chip for holding the chip itself.

However, in the case of a micro-structured chip such as, for example, Type 0603 (that is, 0.6 mm×0.3 mm×0.3 mm), there is less space in the chip itself for the holding portion and, therefore, the electrode structure as described above has been a bottle neck for meeting the requirement of micro-structure or micro-miniaturization. Thus, the conventional laminated inductor has serious problems with respect to reliability, performance capability and production efficiency in coping with the recent requirement of miniaturization, thinner designing, higher speed operation, etc.

SUMMARY OF THE INVENTION

It is, therefore, a primary object of the present invention to provide, in view of the problems and difficulties in the conventional structure, an improvement in a laminated inductor.

Another object of the present invention is to provide a new laminated inductor, which permits reduction of stray capacitance between the coil and the terminal electrodes so that the inductor is adaptable for a high frequency application.

A further object of the present invention is to provide an improved laminated inductor which has a suitable bonding strength at the chip mounting step and which meets the requirements of micro-miniaturization.

Another object of the invention is to provide a method of forming the improved laminated inductor described above.

According to a first aspect of the present invention, there is provided a laminated inductor comprising a plurality of electrically insulating layers (2), a plurality of electrically conductive patterns, and terminal electrodes. The electrically insulating layers and the conductive patterns are alternately superimposed with each other, and the electrically conductive patterns are connected with each other at the ends thereof to form a coil (3) in a laminated form. The terminal electrodes (4, 5) are arranged at opposed end portions of a chip, and a starting end and a terminal end of the coil extend, to connect the terminal electrodes. The terminal electrodes are formed on at least opposed end surfaces (1*d*) and a lower surface (1*b*) of the chip.

According to a modification of the structure of the invention described above, the terminal electrodes are formed not only on the opposed end surface and the lower surface of the chip but also on an upper surface of the chip.

FIG. 3 shows a case in which no terminal electrode is provided on the upper surface and the side surface of the chip, and FIG. 4 shows a case in which no terminal electrode is provided on the side surface of the chip. In the electrode structure of either case, distance between the coil and the extended portion of the terminal electrode can be reduced relative to the conventional structure. Therefore, a stray capacitance between the coil and the electrode can be reduced so that the structure of the present invention can meet with the requirement of high frequency applications.

In a second aspect of the invention, the terminal electrodes (4, 5) on both the upper and lower surfaces (1*a*, 1*b*) of the chip is formed during a laminating process of production.

By forming the electrodes on the upper and lower surfaces of the chip in the process of the lamination for forming the coil, it is sufficient to apply an electrode paste to the limited surface to which the conductive material is coupled. In other words, the application of the electrode paste can be limited to the connecting portion of the conductive member. Therefore, it is not necessary to prepare expensive equipment for controlling a flow or running the paste extensively to an unnecessary portion which has been needed in the conventional dip method. Thus, the production procedure can be simplified to provide reduction in manufacturing cost.

In a third aspect of the invention, the terminal electrode surface on the upper surface of the chip is made smaller in size than the terminal electrode surface on the lower surface of the chip.

With respect to the size of the terminal electrodes described above, since electrical measurements are generally conducted by contacting a measurement terminal to an upper surface of the chip, a relatively large terminal electrode of the upper surface will be convenient to proceed the contact of the measurement terminal onto the electrode. However, providing a large terminal electrode causes generation of a stray capacitance. In the embodiment of the invention, as shown in FIG. 5, the electrode on the upper surface of the chip is designed to be smaller than the electrode on the lower surface of the chip. Consequently, there is less influence of a stray capacitance, with the contact of the measurement terminal to the electrode of the upper surface being maintained. This will increase or raise a resonance frequency and improve a Q-factor of the coil.

According to a fourth aspect of the invention, a terminal electrode on the upper surface where an upper end of the coil is directed out is formed larger than the terminal electrode of the other terminal electrode on the same upper surface so that directional target can be obtained for taking out the wound coil.

In the structure described above, as the difference in the electric potential of the conductive members is larger, the stray capacitance between the conductive members becomes more remarkable. Therefore, if a terminal electrode is formed on the upper surface of the chip, then even though a terminal electrode having a smaller potential difference on the side of the pulled-out pattern is larger than the other terminal electrode of larger potential difference, there is less or substantially no increase in stray capacitance. FIG. 6 shows the difference in size of the terminal electrodes on the left side and the right side of the upper surface of the chip. Thus, by modification of the size of the terminal electrodes on the upper surface of the chip, the direction in which the wound coil is pulled out can be adjusted. Therefore, it is not necessary to provide a forming step or steps for a directional marker to eliminate the number of steps of production. In this case, there is no problem of property deficiency by the reasons set forth above.

Further, in another (a fifth) embodiment of the invention, the coil is positioned close to the upper surface of the chip (i.e., closer to the upper surface than the lower surface) so that a predetermined distance is obtained between the coil and the terminal electrode on the lower surface of the chip.

As explained above, although a stray capacitance between the coil and the terminal electrodes on the upper surface of the chip is reduced, a stray capacitance relative to the lower surface of the chip is maintained. This is due to the fact that the extended portion of the terminal electrodes on the lower surface of the chip could not be formed as small as desired in order to provide a desired bonding strength at the time of mounting or packaging. Thus, in the fifth embodiment of this invention shown in FIG. 7, the coil is formed at the position adjacent to, or closer to, the upper surface of the chip where the terminal electrodes are small so that there is less influence of a stray capacitance, and the distance relative to the lower surface of the chip is increased. By this structure (structure of FIG. 7), reduction of the stray capacitance is achieved with a large size of the terminal electrodes having a suitable bonding strength being maintained.

In a sixth embodiment of the invention, the coil is formed in an expanded posture toward the sides of the chip where no terminal electrode is formed. If the coil is exposed from the side surface of the chip, the exposed portion of the coil is subject to an insulating treatment.

As shown in FIGS. 8, 9(*a*), 9(*b*) and 10, the coil extends toward the side surfaces of the chip where no terminal electrode is formed and less stray capacitance is generated so that a coil area is expanded. This structure permits an increase in the inductance value (L-value) with the resonance frequency being maintained at a high level. Further, since the same high level of L-value can be achieved by a relatively small number of windings, the number of the steps for a coil manufacturing process can be reduced.

Further, if the coil is largely extended so that its side portion is exposed on the side of the chip, it is desired that the exposed portion be insulated by resins or the like for the purpose of obtaining reliability.

In a seventh aspect of the present invention, there is provided a method of forming a laminated inductor, comprising laminating a plurality of conductive patterns with an electrically insulating layer (1) being superposed between the conductive patterns to form a plurality of coils (3) at one time to thereby provide a laminated block (21). The laminated block (21) is cut in the direction of exposure of a pulled-out pattern of the coil (3) to thereby form a plurality of block chips (22) having cut surfaces (22*a*, 22*b*). Conductive layers (24, 25) are formed on the side of both of the cut surfaces, and the block chip (22) is cut into chip units.

In the forming method of the invention described above, the electrodes are formed on the longitudinal structure of the block chips and in the process of production of the electrodes, a chip holding portion can be obtained for supporting the chips. Therefore, the method is effective for, ind has advantages in, production of the electrode of micro-miniaturized chips.

In an eighth aspect of the invention, there is provided a new laminated inductor comprising a laminated structure of a plurality of electrically insulating layers (2) and a plurality of conductive patterns. The conductive patterns are connected with each other at the ends thereof to form a coil (3) in an electrically insulating layer body, the coil being superimposed in a laminating direction. The terminal electrodes (4, 5) are formed on chip end surfaces and a chip lower surface for connecting therewith the coil, and an extended conductive layer is formed around an end surface of the chip for forming thereon the terminal electrode.

By forming the extended or overlapping conductive layer, a reliable coupling is made between the electrode on the end of the chip and the electrode of the lower surface of the chip. The overlapping layer is preferably made as small as possible and practically 50–100 $\mu$m is preferred.

In a ninth embodiment of the invention, the terminal electrodes on the lower surface of the chip are formed during the process of the lamination, and the terminal electrodes on the end surface of the chip are formed after chamfering of each chip after sintering.

By the chamfering, entangling of the chips can be prevented at the time of treatment or handling of the chips. After chamfering, provision of the extended or overlapping layer portion ensures a reliable connection between the electrodes of the chip end surface and the electrodes of the upper and lower surfaces of the chips.

DETAILED DESCRIPTION OF THE EMBODIMENTS

Figure 1:
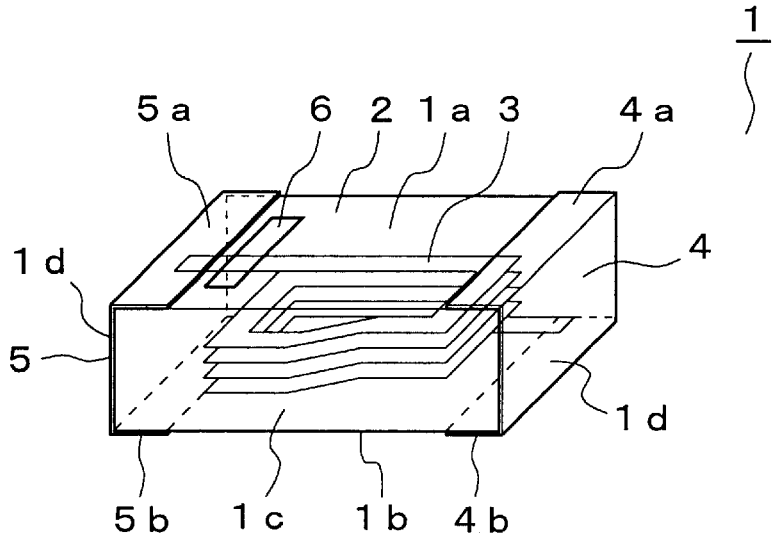
FIG. 1 is a transparent perspective view of a laminated inductor according to the present invention, showing an inner structure of the inductor.

Preferred embodiments of the invention will be described with reference to the drawings, in which the same reference numerals are used for the same or common parts and elements throughout the various embodiments of the invention.

With reference to FIG. 1, a laminated inductor 1 of the present invention has a plurality of electrically insulating layers of a magnetic or non-magnetic material and a plurality of conductive patterns arranged in such a manner that the each of the electrically insulating layers is alternately laminated with respect to each of the conductive layers. The conductive patterns are connected with each other to form a coil 3 which is superimposed in the laminating direction in an electrically insulating layer body 2. The ends of the coil 3 are extended to the terminal electrodes 4, 5 on the opposed ends of the chip to form a laminated chip of rectangular parallelepiped configuration. In the drawing, reference numeral 6 represents a directional marker which is formed on the upper surface of the chip.

Figure 14:
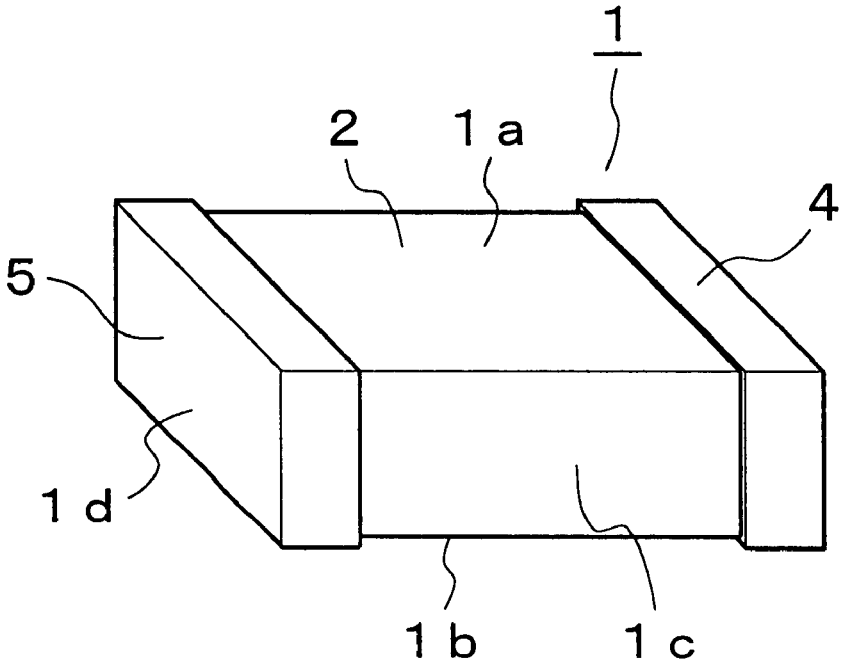
FIGS. 14(*a*) and 14(*b*) are diagrams showing the conventional prior art laminated inductor.
Figure 14:
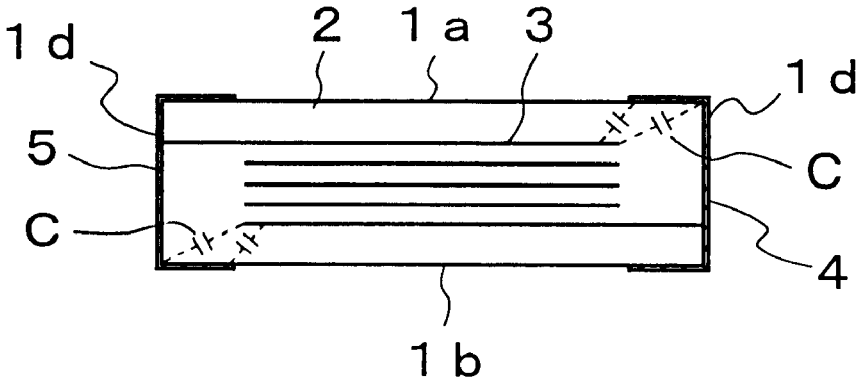

The coil structure itself is similar to that of the conventional prior art coil with the exception of the shape and structure of the terminal electrodes 4, 5. In other words, in the conventional structure, opposed ends are enveloped or covered and the chip side surfaces as well as chip upper and lower surfaces are provided with a box-shaped terminal electrodes 4, 5 as illustrated in FIG. 14(*a*). In addition, in the present invention a terminal electrode is not provided on the side surfaces 1*c* of the chip whereas the electrodes 4, 5 are provided on the upper surface la, the lower surface 1*b*, and opposed end surfaces 1*d* as shown in FIG. 1.

With reference to FIGS. 2(*a*) through 2(*j*), a process of forming a coil of the laminated inductor 1 will be explained. As examples of a method of forming a coil, a sheet lamination method in which ceramics are formed into a sheet configuration, and a print-lamination method in which all the electrically insulating layers and the inner conductive patterns are formed by a screen printing technique have been known as useful techniques. The explanation of the present invention will heretofore be made with respect to the latter method, that is, print-lamination method, but it should be understood that other methods such as the sheet lamination method can also be used.

According to the print-lamination method described above, terminal electrodes 4*b*, 5*b* of the opposed ends are formed or printed in the first step as shown in FIG. 2(*a*). These electrodes 4*b*, 5*b* are terminal electrodes on the lower surface of the chip. In the next step, a winding coil having a predetermined number of turns is formed through the steps shown in FIG. 2(*b*) to 2(*h*) which are equivalent to the steps in the conventional print-lamination method. The process then proceeds to the step of FIG. 2(*i*) where terminal electrodes 4*a*, 5*a* on the upper surface of the chip are formed by printing. In the last step, a marker 6 is printed as shown in FIG. 2(*j*) to complete the printing process. If the electrodes are formed solely on the lower surface of the chip, it is sufficient to proceed to a one-side printing and, therefore, the step shown in FIG. 2(*i*) is omitted as will be described presently. A conductive paste to be used will preferably be selected from those containing glass, for the purpose of providing a suitable bonding strength.

For the purpose of comparison and enhancing the understanding of the invention, an example of the conventional prior art production method will be explained. In the first step of FIG. 2(*b*), a dielectric ceramic material 11 is repeatedly printed and laminated until it has a predetermined thickness to form a laminate body, and a leading pattern 12 which serves to lead a starting end of the coil to the terminal electrode side is printed at the step of FIG. 2(*c*). Then, at the step of FIG. 2(*d*), a dielectric ceramic layer 11 is printed to cover a "lower half surface portion" (of FIG. 2(*d*) of the drawing) of the laminate body. The step of FIG. 2(*e*), an L-shaped coil pattern 12 is printed so that it is connected with the left end of the exposed leading pattern which is not covered by the dielectric ceramic layer 11 as illustrated in FIG. 2(*e*) so that a half turn of the coil is formed. Then, at the next step shown in FIG. 2(*f*), a ceramic layer 11 is printed on an "upper half surface portion" (of FIG. 2(*f*) of the drawing) of the laminate body to cover the connected portion described above. The step of FIG. 2(*g*), another coil pattern 14 which is of an inverted L-shape is printed to be connected with the right end of the exposed coil pattern 13 so that the other half turn of the coil is formed.

After that, the steps of FIGS. 2(*d*)–2(*g*) are repeated to provide a winding coil of a predetermined number of turns.

By the steps of the process described above, a laminated block having a plurality of coils which have been formed in one lot or bulk is provided. The laminated block is then cut and sintered as a unit of a chip and each chip is provided with terminal electrodes 4, 5 at its opposite ends. and then followed by a printing/plating process so that a predetermined inductor 1 shown in FIG. 1 is completed. FIG. 1 depicts that there is no extension of electrodes along the side surfaces but if terminal electrodes are formed on a unit of a chip, it will be possible that the electrodes partly extend to some extent to the side surfaces according to the steps of the process.

In the embodiment of the present invention, the extended portion of the terminal electrodes 4, 5, the extended portion being the electrodes (hereinafter referred to as electrode extension 4*a*, 5*a*, 4*b*, 5*b*) on the upper and lower surfaces of the chip, is formed by printing in the laminating step for forming a coil 3. Thus, according to the present invention, the electrodes on the opposite ends of the chip to which a coil end is connected can be formed altogether in bulk, by applying screen printing, stamp-printing, sputtering, deposition or simple dipping, etc. after a number of chips are aligned or arranged in a line, other than by the conventional complex dipping method which has difficulty in controlling the thickness. Therefore, the present invention permits realization of electrodes having a high dimensional accuracy with less cost. With respect to the chips of microstructure such as the chip of No. 0603 Type, the chip has no space or portion for supporting itself and, therefore, the conventional technique of dipping is not suitable for production of electrodes for the micro-structured chips. By contrast, the present invention is suitable for production of electrodes of the microstructure by applying the aforementioned desired techniques such as screen printing, stamp printing, sputtering, depositing, etc.

Figure 3:
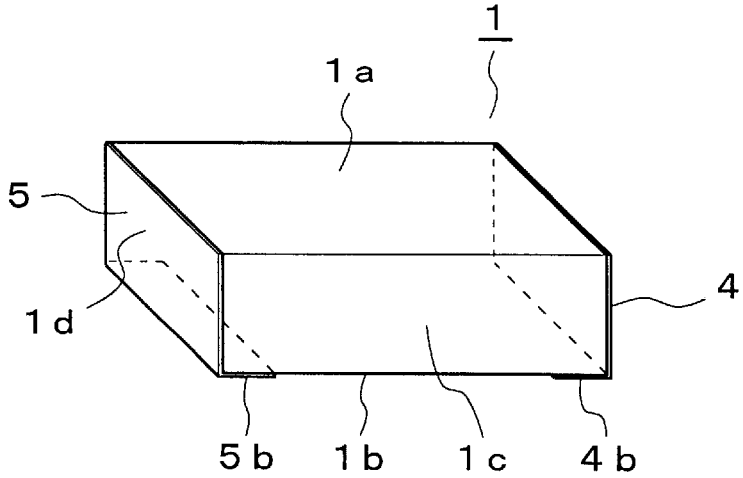
FIGS. 3(*a*) and 3(*b*) are diagrams showing the laminated inductor according to another embodiment of the invention, wherein FIG. 3(*a*) is a perspective view and FIG. 3(*b*) a side view.
Figure 3:
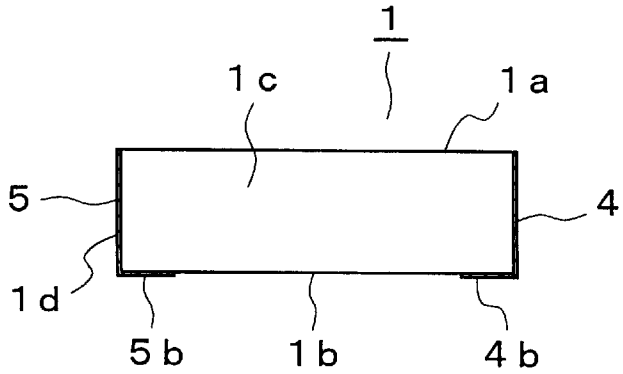
Figure 2A:
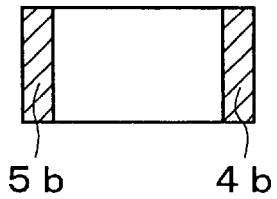
FIGS. 2(*a*) to 2(*j*) are diagrams showing the steps of forming the laminated inductor shown in FIG. 1.
Figure 2B:
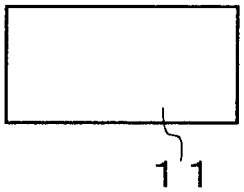
Figure 2C:
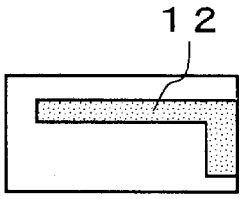
Figure 2D:
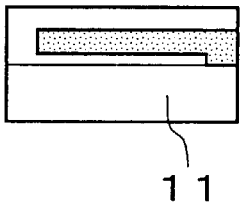
Figure 2E:
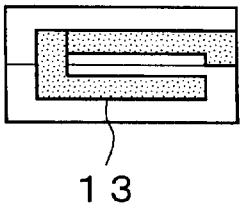
Figure 2F:
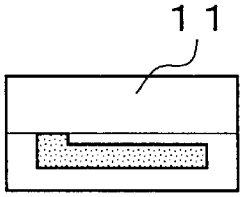
Figure 2G:
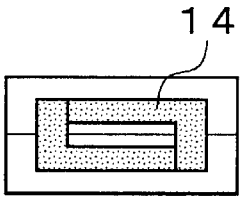
Figure 2H:
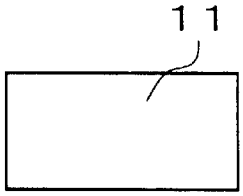
Figure 2I:
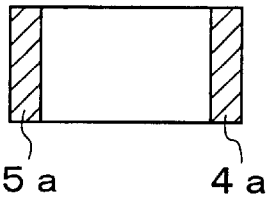
Figure 2J:
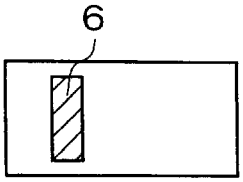
Figure 4:
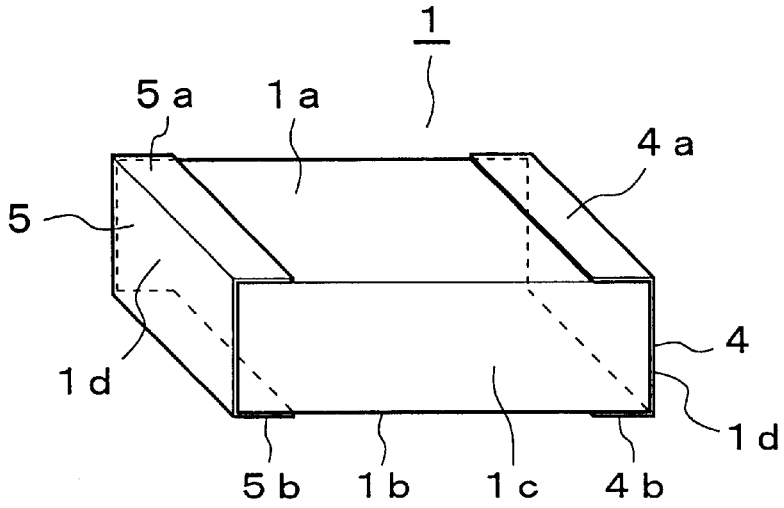
FIGS. 4(*a*) and 4(*b*) are diagrams showing the laminated inductor according to a further embodiment of the invention, wherein FIG. 4(*a*) is a perspective view and FIG. 4(*b*) a side view.
Figure 4:
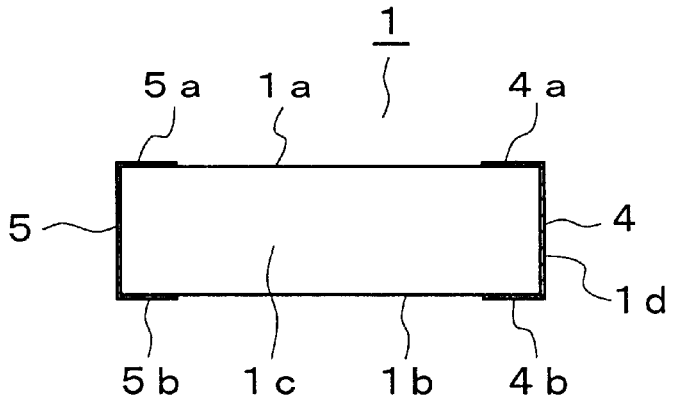

In the present invention, the electrode extensions or overhanging portions 4*a*, 5*a*, 4*b*, 5*b* are formed by a printing technique. Therefore, various types and structures of electrodes can be selectively and readily formed by selecting electrode patterns to be formed. For example, an electrode having a U-shape as shown in FIGS. 4(*a*) and 4(*b*) and an electrode having an L-shape as shown in FIGS. 3(*a*) and 3(*b*) can be formed quite easily by the present invention. In the structure of the electrodes described above, no electrode is formed on the opposite side surfaces 1*c* of the chip and, therefore, the proximity between the coil 3 and the electrode extensions can be restricted as much as possible so that a stray capacitance between these elements can be minimized. Consequently, it is possible to provide a high resonance frequency to thereby permit micro-miniaturization with a high Q-factor of the coil being maintained.

Figure 12:
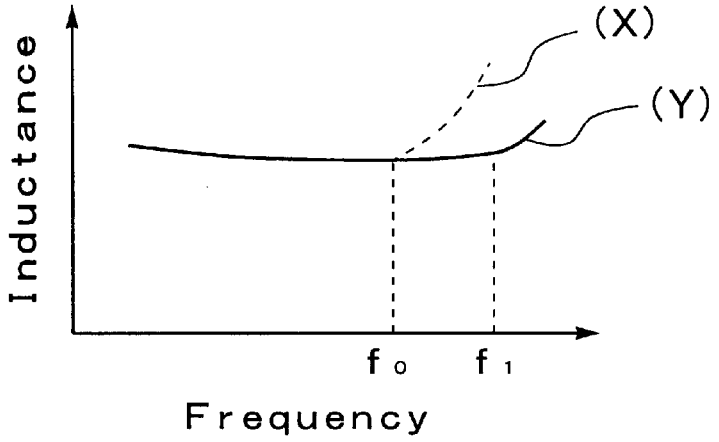
FIG. 12 is a graph showing a frequency characteristic of the laminated inductor according to the present invention and a comparative frequency characteristic of the inductor of the prior art shown in FIG. 14.
Figure 13A:
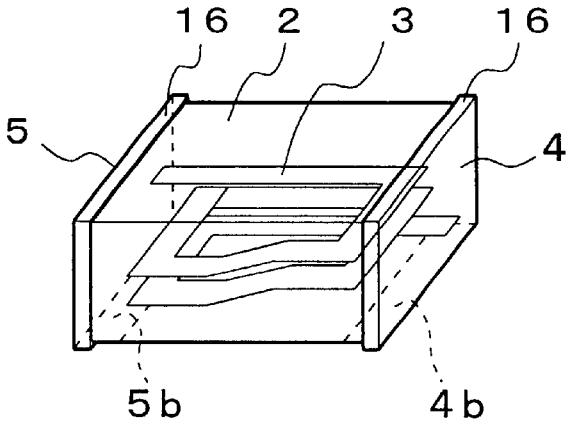
FIGS. 13(*a*) and 13(*b*) are diagrams showing an extended or overlapping portion of the conductive layer at the time of formation of the electrode.
Figure 13B:
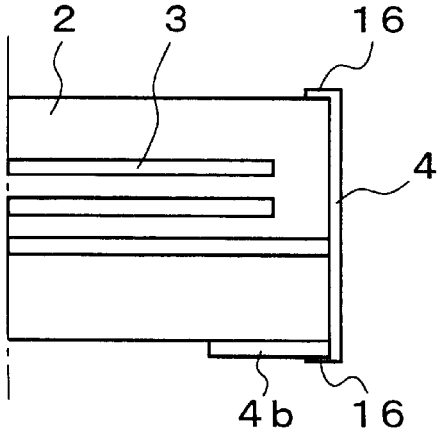

FIG. 12 shows frequency characteristics (Y) of the inductor of the present invention shown in FIGS. 3(*a*) and 3(*b*), and frequency characteristics (X) of the conventional prior art inductor. As shown the graph, a resonance frequency of the present invention is traced at a higher level than the conventional prior art. For example, if a chip has an L-value of 10 nH, the inductor of the present invention exhibits a resonance frequency f1 of 4.5 Ghz, whereas the conventional technique exhibited an f0 of 3.7 Ghz.

Modifications of the embodiment of the present invention will be described.

Figure 5:
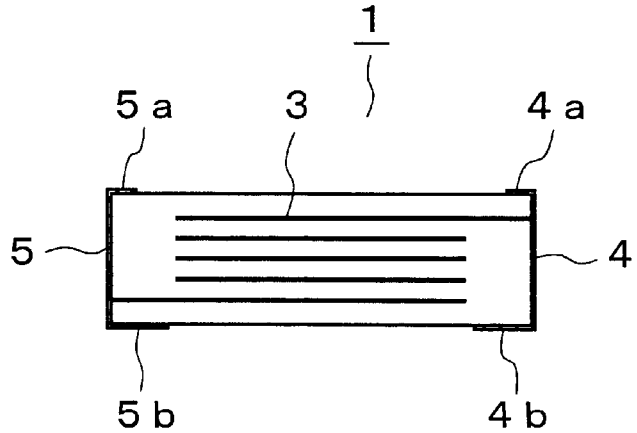
FIG. 5 is a sectional side view of the laminated inductor according to the present invention, showing a shape and structure of the terminal electrodes.

With reference to FIG. 5 which is a modification of the embodiment of FIGS. 4(*a*) and 4(*b*), the electrode extensions or overhanging portions 4*a*, 5*a* on the upper surface of the chip are formed smaller than the electrode extensions or overhanging portions 4*b*, 5*b* on the lower surface of the chip.

As in the structure of FIGS. 4(*a*) and 4(*b*), if the electrode extensions 4*a*, 5*a* are provided on the upper surface of the chip, there is an advantage that a bonding or soldering nature at the time of mounting (packaging) is easily recognized. On the other hand, there is a disadvantage that a stray capacitance is generated at the electrode extensions. In order to minimize the disadvantage of generation of a stray capacitance, as illustrated in FIG. 5, the electrode extensions 4*a*, 5*a* on the upper surface of the chip are made smaller than the electrode extensions 4*b*, 5*b* on the lower surface of the chip, and a distance to the coil 3 is suitably obtained. Therefore, an influence of the stray capacitance is restricted with the aforementioned advantage of recognition of bonding (soldering) nature or effect being held.

Figure 6:
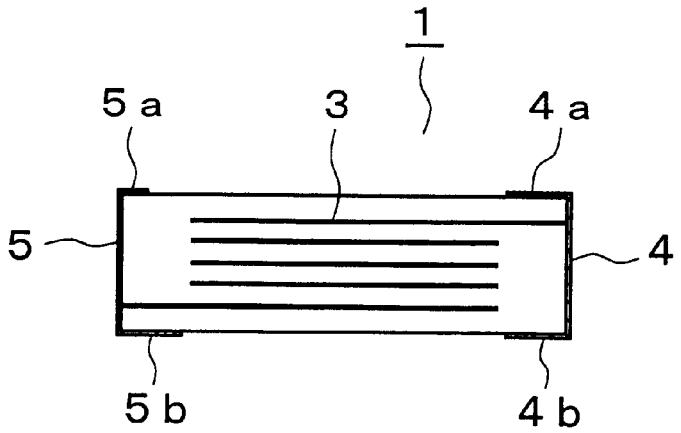
FIG. 6 is a sectional view of the laminated inductor according to another embodiment of the invention, showing another type of the terminal electrodes.

In FIG. 6 which shows another modification, the electrode extension 4*a* on the side to which the upper end of the coil 3 is led or directed is made larger in size than the electrode extension 5*a* of the other side, so that it is easy to recognize or determine the position of the lead-out portion of the coil. This structure will allow the marker 6 shown in FIG. 2(*j*) to be omitted.

Generally, a stray capacitance between conductors is remarkable as the difference in electric potential between the conductors becomes larger. Therefore, it is not likely that a stray capacitance is generated on the terminal electrode 4, where the leading pattern is formed and the electric potential difference is small, even when the coil 3 is positioned closer. Thus, the electrode extension 4*a* is made larger, and the other electrode extension 5*a* at which electric potential is relatively large and a stray capacitance is likely to be generated is made as small as possible so that a predetermined or desirable distance to the coil 3 is assured. The thus formed inductor is advantageous because there is no increment of stray capacitance and there is no deficiency in properties of the coil 3.

In all the embodiments described above, stray capacitance between the terminal electrodes 4, 5 on the upper surface of the chip and the coil 3 is reduced. However, a stray capacitance between the terminal electrodes 4, 5 on the lower surface of the chip is still present, because it is not possible that the electrode extensions 4*b*, 5*b* on the lower surface of the chip is made smaller for the purpose of obtaining a desired bonding strength at the packaging.

Figure 7:
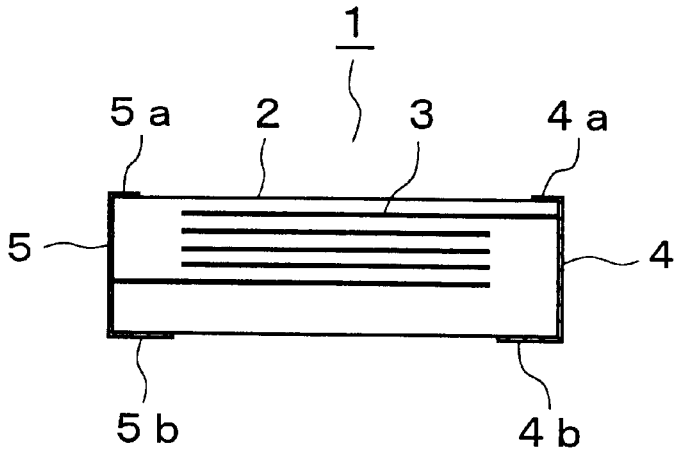
FIG. 7 is a sectional view of the laminated inductor according to the invention, showing a forming position of the coil.

The structure of FIG. 7 is an effective attempt at solving the problem described above. In FIG. 7, the position of the coil 3 is designed to be located as close to the upper portion of the chip as possible such that a suitably large distance can be maintained between the coil 3 and the electrode extensions 4*b*, 5*b* on the lower surface of the chip. In this case, the distance between the upper surface of the chip and the coil 3 is determined to be more than 50 $\mu$m in view of problems of damage or breaking of the dielectric ceramic 2. The position determination of the coil can be easily controlled by the coil formation process which is the same as the process described with reference to FIGS. 2(*b*) through 2(*h*).

In the structure of FIG. 7 the electrode extensions 4*a*, 5*a* on the upper surface of the chip to which the coil is positioned closer are designed to be as small as possible (or omitted if desired) to prevent generation of the stray capacitance. However, the necessary bonding strength is maintained as in the conventional prior art technique, because the electrode extensions 4*b*, 5*b* on the lower surface are kept large.

Figure 8:
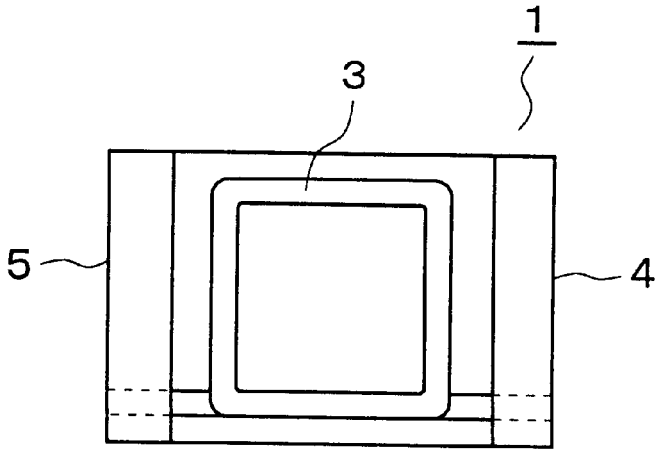
FIG. 8 is a plan view of the laminated inductor according to the invention, showing the shape of the coil.
Figure 9:
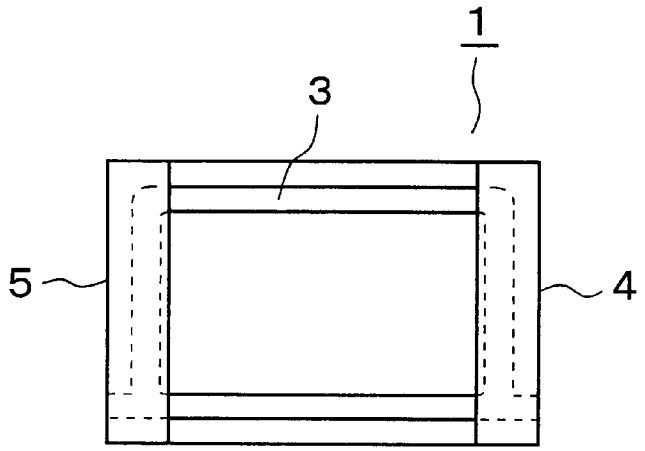
FIGS. 9(*a*) and 9(*b*) are diagrams showing the shape of the coil of another embodiment of the invention, wherein FIG. 9(*a*) is a transparent plan view and FIG. 9(*b*) a sectional side view.
Figure 9:
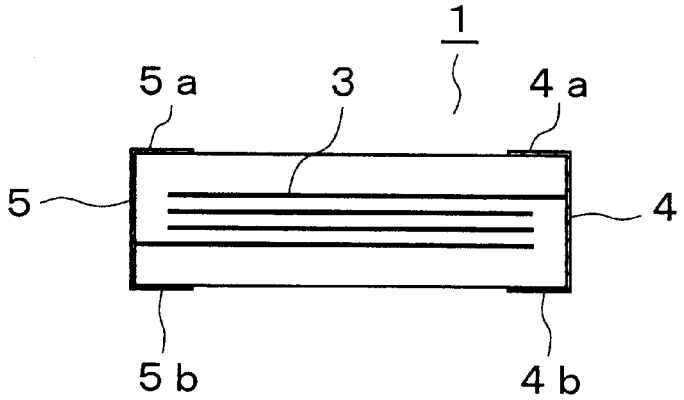

FIGS. 8, 9(*a*), 9(*b*) and 10 show further embodiments of the invention, in which the coil 3 is expanded in the direction of the side surfaces of the chip where no terminal electrode 4, 5 is provided and less stray capacitance is generated so that a coil area is increased. This will provide a high L-value (inductance value) with the high resonance frequency being maintained.

In the embodiment of FIG. 8, the coil 3 is formed such that it expands solely to the side surfaces of the chip and does not extend near the terminal electrodes 4, 5. In the embodiment of FIGS. 9(*a*) and 9(*b*), the coil 3 is designed to expand also to the terminal electrodes 4, 5 so that a further expansion or increase in the coil area is obtained. By expansion of the coil area, a high or predetermined level of L-value can be obtained with less number of turns of the coil. Therefore, the coil 3 can be formed closer to the central position in the vertical direction of the chip as illustrated in FIG. 9(*b*), so that a larger distance between the coil 3 and the electrode extensions 42, 4*b*, 5*a*, 5*b* can be ensured. Thus, there will be no problem of stray capacitance even if the coil 3 is expanded toward the terminal electrodes. Further, in this structure the number of steps for forming the coil in order to obtain the predetermined L-value can be reduced and dispersion of L-values can be restricted.

Figure 10:
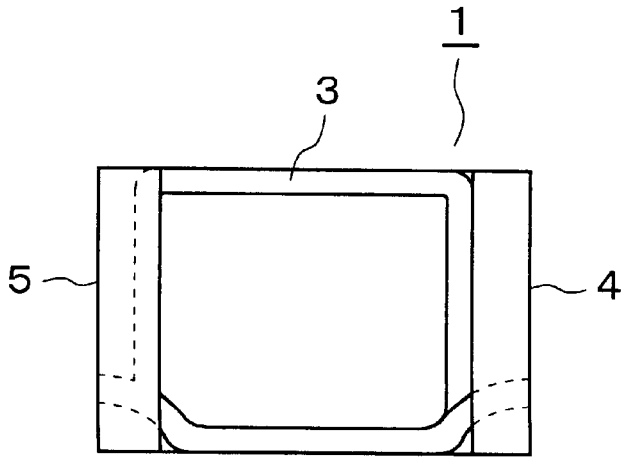
FIG. 10 is a transparent plan view of another type of the coil according to another embodiment of the invention.
Figure 11A:
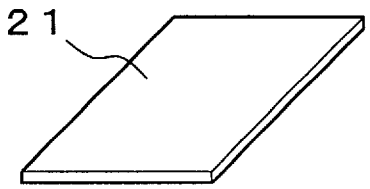
FIGS. 11(*a*) to 11(*i*) are diagrams showing the steps of production of a chip from a laminated inductor block.
Figure 11B:
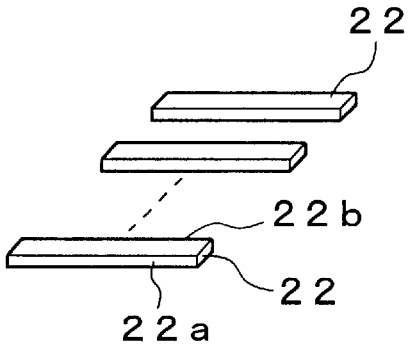
Figure 11C:
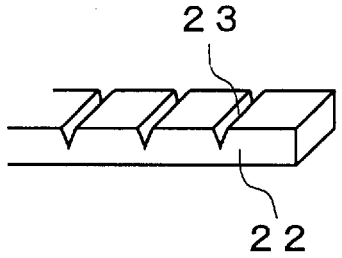
Figure 11D:
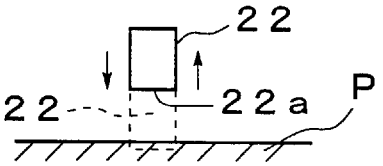
Figure 11E:
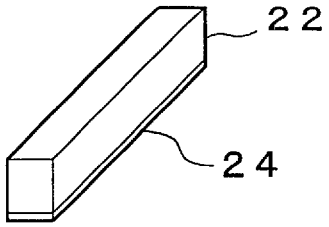
Figure 11F:
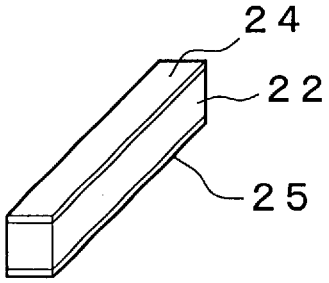
Figure 11G:
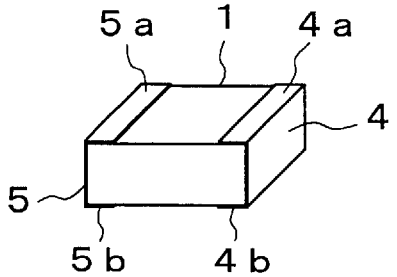
Figure 11H:
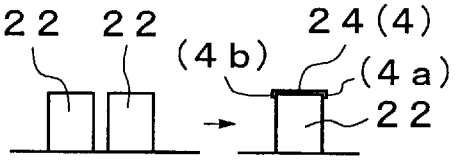
Figure 11I:
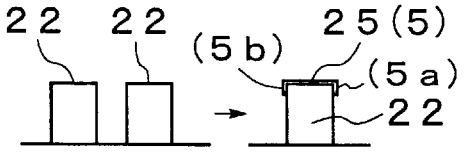

In the embodiment of FIG. 10, the coil 3 is extensively and largely expanded so that the side portion of the coil 3 is exposed on the side surface of the chip. By exposing the side portion of the coil 3, a further large L-value can be obtained. In this structure, however, care must be taken so that the exposed portion is suitably subject to an insulating treatment by using resins or the like.

In the embodiments of the invention describal above, the block which is formed by printing and laminating is cut into chips and then terminal electrodes are formed on the chips. When the electrodes are formed on the end surfaces of the chip by a dipping or stamp-printing technique, small extensions of the conductive layer 16 are formed on the surface around the end surface of the chip, the extensions or overlapping portions of the conductive layer 16 are controlled to be in the range of 50–100 $\mu$m from the viewpoint of a stray capacitance problem and the nature of connection between the electrodes 4, 5 on the end surface of the chip and the electrode extensions 4*b*, 5*b*.

The chips are chamfered by barrel polishing before formation of the terminal electrodes so as to prevent the chips from being caught at the time of alignment, mounting, etc. Due to the structure in which the extensions or overlapping portions of the conductive layer 16 are slightly overlapped with the electrode extensions 4*b*, 5*b*, a reliable connection between the electrodes 4, 5 on the end surface of the chip and the electrode extensions 4*b*, 5*b* is assured. By enlarging the extensions or overlapping portions, a connection property of the electrode on the lower surface is enhanced and, at the same time, a measurement terminal can be pushed from above to contact the electrodes. Therefore, it is not necessary to use the conventional complex method in which the measurement terminal contact the terminal surface or lower surface.

A process for producing a micro-miniaturized chip such as the chip 0603 Type will be explained with reference to FIGS. 11(*a*) to 11(*i*).

In the first step, a laminated block 21 in which a plurality of coils are altogether formed on the same surface by the conventional printing steps of FIGS. 2(*b*) to 2(*h*) is formed as illustrated in FIG. 11(*a*). At the step of FIG. 11(*b*), the laminated block 21 is cut into oblong strips in the direction that the lead pattern of the coil is exposed to thereby form a plurality of longitudinal block chips 22. At this moment, it will be desired that a groove or a slit 23 be provided on each chip unit for facilitating separation of the block chip into chip units as shown in FIG. 11(*c*).

In the next step, as shown in FIG. 11(*d*), one cut surface 22*a* of the block chip 22 is dipped into the conductive paste P for formation of the terminals, and then a conductive layer 24 having an extended or overlapping portion which extends toward the side surface of the chip is formed. The conductive layer 24 serves as a terminal electrode 4 on one side when it is formed into a chip. Here, it is to be understood that the conductive layer 24 can be formed by sputtering or depositing rather than by dipping technique as described. In case of sputtering, if the block chips 22 are aligned relatively close to each other as shown in FIG. 11(*h*), the extended portion of the conductor is small and the terminal electrode 4 having small sized electrode extensions 4*a*, 4*b* can be formed. On the other hand, if the block chips 22 are aligned in a relatively large spaced relation as shown in FIG. 11(*i*), the extended portion of the conductor becomes large so that the terminal electrode having a relatively large electrode extensions 4*a*, 4*b* can be formed. Accordingly, by adjusting the distance between the adjacent block chips 22 in the sputtering technique, size of the electrode extensions can be controlled as desired.

In the next step shown in FIG. 11(*f*), the other cut surface 22*b* of the block chip 22 is similarly dipped into the paste P to form a conductive layer 25. This conductive layer 25 serves as the other terminal electrode 5 when it is formed into a chip. In the final step shown in FIG. 11(*g*), the block chip 22 is cut in a longitudinal direction to provide chip units and each chip is subject to sintering to provide a laminated inductor 1. If needed, the sintering can be performed after the step of FIG. 11(*b*).

The method described above with reference to FIGS. 11(*a*) to 11(*i*) is slightly inferior to the previous embodiments of the invention shown and described with reference to FIGS. 1 to 10 in which each chip is separately handled, as far as a dimensional accuracy of the electrode extensions 4*a*, 5*a*, 4*b*, 5*b* is concerned. However, it is rather advantageous for ensuring a supporting or holding portion of the chip in the process of forming the electrodes because each of the each has a laterally longitudinal configuration. Although not illustrated in the drawings, if the electrode extensions are previously printed in the process of lamination as in the embodiments of FIGS. 1 to 10, it is sufficient that the conductive layer is formed on the cutting surfaces 22*a*, 22*b* without consideration of extending or overlapping portions of the conductive material in the steps of FIGS. 11(*d*) to 11(*f*). Therefore, a high dimensional precision of the electrode extensions can be obtained. This method is particularly suitable for forming electrodes for micro-miniaturized chips.

According to a first aspect of the present invention, the terminal electrodes are formed on the end surface and the lower surface of the chip or on the end surface of the chip and upper and lower surfaces of the chip, and no terminal electrode is formed on the side of the chip. This structure can reduce proximal portion between the coil and the terminal electrode so that a stray capacitance can be eliminated. By this structure, a high resonant frequency can be obtained to meet the requirement for high frequency applications. Additionally, the Q factor of the coil can be improved.

In the second aspect of the invention, since the terminal electrodes on the upper and lower surfaces of the chip are formed in the laminating process for forming coils, a less expensive method with more freedom can be realized, without depending upon the process of electrode formation by the conventional dipping method.

In the third aspect of the invention, the terminal electrode surface on the upper surface of the chip is made smaller than the terminal electrode surface on the lower surface of the chip. Therefore, a stray capacitance between the coil and the terminal electrode on the upper surface of the chip will be minimized, and this will make it possible to realize high frequency applications.

In the fourth aspect of the invention, the terminal electrode surface of the side at which the upper end of the coil is extended is made larger than the terminal electrode surface of the other side of the chip. This can eliminate the need for the directional marker, so that a reduction in cost can be attained by eliminating the production of the direction marker. Besides, there is no increase in stray capacitance by the electrode structure and therefore there is no deterioration of coil characteristics.

In the fifth aspect of the invention, the coil is formed near the upper surface of the chip to thereby preserve distance between the coil and the terminal electrode on the lower surface of the chip. This structure permits further reduction of stray capacitance while sufficiently preserving the bonding strength at the time of chip mounting.

In the sixth aspect of the invention, the coil is expanded toward the chip side on which no terminal electrode is formed. This permits an increase in the L-value with the resonance frequency being maintained high. Further, since an L-value of the same level can be realized by less winding, steps for the coil formation can be reduced to reduce a cost for production and restrict scattering of the L-values.

Further, if the coil is extensively expanded to such an extent that the coil side is exposed to the side surface of the chip, the exposed portion is subject to an insulation treatment with resin or the like to obtain a reliability.

In the seventh aspect of the invention, the laminated block having thereon a plurality of coils is cut to form a plurality of block chips, and terminal electrodes are formed on the opposed cut surfaces of the block chips and then cut into chip units. Thus, a chip supporting portion which is used for forming the electrode can. be preserved. This is advantageous for micro-miniaturization of the chip.

In the eighth aspect of the invention, the extended conductive layer is formed around an end surface of the chip for forming thereon the terminal electrode. This provides a reliable connection between the electrode of the end surface of the chip and the extended portion of the electrode.

Further, in the ninth aspect of the invention, the terminal electrodes on the end surface of the chip are formed after each chip is chamfered. This can avoid entangling the chips so that a stable mounting of the chips can be established. After chamfering, a reliable connection between-the electrode on the end surface of the chip and the electrode (electrode extension) on the upper and lower surface of the chip can be obtained with the aid of the extended conductive layer around the chip end surface.

What is claimed is:

1. A laminated inductor comprising:

a chip portion having an upper surface, opposed end surfaces, and a lower surface, said chip portion including:

a plurality of electrically insulating layers; and a plurality of electrically conductive patterns formed on said insulating layers such that said insulating layers and said conductive patterns are alternately superimposed, said conductive patterns having ends electrically connected so as to form a laminated coil; and terminal electrodes formed at each of said opposed end surfaces of said chip portion, said laminated coil having a first end connected to a first of said terminal electrodes and a second end connected to a second of said terminal electrodes so as to electrically connect said terminal electrodes, each of said terminal electrodes having an end surface portion formed on a respective end surface of said chip portion and having a lower surface portion formed on said lower surface of said chip portion, said laminated coil being arranged closer to said upper surface of said chip portion than to said lower surface of said chip portion so as to define a predetermined distance between said laminated coil and said lower surface portion of each of said terminal electrodes.

2. The laminated inductor of claim 1, wherein each of said terminal electrodes further has an upper surface portion formed on said upper surface of said chip portion, said upper surface portion of each of said terminal electrodes being smaller than said lower surface portion of each of said terminal electrodes.

3. The laminated inductor of claim 2, wherein said upper surface portion and said lower surface portion of each of said terminal electrodes comprise screen-printed layers.

4. The laminated inductor of claim 3, wherein said chip portion further has opposed side surfaces, said laminated coil being formed so as to include conductive patterns arranged at each of said opposed side surfaces so as to form a portion of each of said opposed side surfaces.

5. The laminated inductor of claim 1, wherein said lower surface portion of each of said terminal electrodes comprises a screen-printed layer.

6. The laminated inductor of claim 5, wherein said chip portion further has opposed side surfaces, said laminated coil being formed so as to include conductive patterns arranged at each of said opposed side surfaces so as to form a portion of each of said opposed side surfaces.

7. The laminated inductor of claim 1, wherein said chip portion further has opposed side surfaces, said laminated coil being formed so as to include conductive patterns arranged at each of said opposed side surfaces so as to form a portion of each of said opposed side surfaces.

8. The laminated inductor of claim 1, wherein said lower surface portion of each of said terminal electrodes comprises a screen-printed layer, and said end surface portion of each of said terminal electrodes comprises a dip-formed layer.

* * * * *